US005894524A

United States Patent [19]

Kotsatos et al.

[11] Patent Number: 5,894,524

[45] Date of Patent: *Apr. 13, 1999

[54] HIGH POWER TWEETER

[75] Inventors: Andrew G. Kotsatos, Arlington; Moses A. Gabbay, Chestnut Hill, both of Mass.

[73] Assignee: Boston Acoustics, Inc., Peabody, Mass.

[ * ] Notice: This patent issued on a continued prosecution application filed under 37 CFR 1.53(d), and is subject to the twenty year patent term provisions of 35 U.S.C. 154(a)(2).

[21] Appl. No.: 08/756,817

[22] Filed: Nov. 26, 1996

Related U.S. Application Data

[63] Continuation of application No. 08/510,192, Aug. 2, 1995, abandoned.

[51] Int. Cl.[6] ..... H04R 25/00

[52] U.S. Cl. ..... 381/397; 381/415; 381/420

[58] Field of Search ..... 381/199, 194, 381/158, 193

[56] References Cited

U.S. PATENT DOCUMENTS

| | | | |
|---|---|---|---|
| 2,217,177 | 10/1940 | Massa | 381/199 |
| 4,550,229 | 10/1985 | Hwang | 381/194 |
| 4,590,332 | 5/1986 | Delbuck | 381/193 |
| 5,390,257 | 2/1995 | Oslac et al. | 381/199 |

FOREIGN PATENT DOCUMENTS

| | | | |
|---|---|---|---|
| 3135003 A1 | 4/1983 | Germany | 381/192 |

OTHER PUBLICATIONS

Product Brochures on Boston Acoustics Neo 1t Tweeter and on Pro Series .2 Tweeter.

*Primary Examiner*—Sinh Tran

*Attorney, Agent, or Firm*—Wolf, Greenfield & Sacks, P.C.

[57] ABSTRACT

A high power compact tweeter which includes a high energy magnet sandwiched between the base of a yoke and top plate which form the magnetic path, the magnet and top plate being spaced from side walls of the yoke by a predetermined gap. A voice coil is positioned in the gap. A heat sink is in thermal contact with the yoke to facilitate, preferably in conjunction with heat transfer management from the speaker.

9 Claims, 2 Drawing Sheets

HIGH POWER TWEETER

This application is a continuation of application Ser. No. 08/510,192, filed Aug. 2, 1995 now abandoned.

FIELD OF THE INVENTION

This invention relates to audio speakers and more particularly to a compact high power tweeter with improved heat management.

BACKGROUND OF THE INVENTION

Conventional tweeters utilize standard ferrous magnets in conjunction with a voice coil to control the speaker cone, dome, or other diaphragm. However, such magnets are relatively large and heavy. Further, such magnets produce significant stray magnetic fields which require bulky shielding to contain, thereby further increasing both the size and weight of the speaker.

However, it is desirable in high fidelity speakers to place the tweeter as close to the woofer as possible so that the sound appears to come from a single source. To achieve this, a sub-compact tweeter assembly is required. It has been found that such a sub-compact design can be achieved by utilizing high energy magnets, such as magnets formed of neodymium-iron-boron (sometimes hereinafter referred to as "neodymium magnet") in place of the standard ferrous magnets. Since such magnets provide a force or energy which, weight for weight, is roughly twenty times stronger than that of conventional magnets, the speakers may operate with a magnet which is roughly the size of a quarter. Further, these smaller magnets generate less stray magnetic field and this field can be contained in a relatively small ferrous yoke assembly. The result is a sub-compact high performance tweeter which provides minimum stray field problems.

However, in order for the speaker to track transients such as those evident in drum hits or acoustic guitar music, the tweeter must be able to handle high levels of power, yet remain cool in operation so as to avoid damage to the speaker coils or the diaphragm. But, one disadvantage of using the compact magnets is that they provide significantly less thermal mass for heat dissipation than more conventional designs and this has been found to present a significant limitation on the levels of power available from such speakers, and thus on the performance thereof. It would therefore be desirable if the advantages of the sub-compact, high-energy magnet tweeters could be achieved while improving the heat management in such tweeters so as to permit high levels of power to be handled.

SUMMARY OF THE INVENTION

In accordance with the above, this invention provides a high power compact tweeter which includes a high energy magnet, a yoke of a ferrous or other high magnetic permeability material, which yoke has a base against which one face of the magnet rests and side walls extending from the base. The side walls surround but are spaced by a selected gap from the sides of the magnet. A top plate which is also of a ferrous or like high magnetic permeability material rests on the face of the magnet opposite the face in contact with the yoke, with the sides of the top plate being surrounded by and spaced by a selected gap from the side walls of the yoke. A voice coil is positioned in at least one of the selected gaps and a diaphragm is operated in response to the magnet and the coil. A heat sink component is in thermal contact with the yoke to facilitate heat management of the tweeter.

For a preferred embodiment, a thermal transfer medium such as ferrofluid is in at least the selected gap in which the voice coil is positioned. The heat sink is preferably in thermal contact with the base of the yoke on the side thereof opposite that in contact with the magnet. For the preferred embodiment, the heat sink has vanes extending therefrom to dissipate heat and is formed of aluminum, a ceramic, or another material having good thermal conductivity. The high energy magnet is preferably a neodymium magnet.

The foregoing and other objects, features and advantages of the invention will be apparent from the following more particular description of a preferred embodiment of the invention as illustrated in the accompanying drawings.

IN THE DRAWINGS

DETAILED DESCRIPTION

Figure 1:
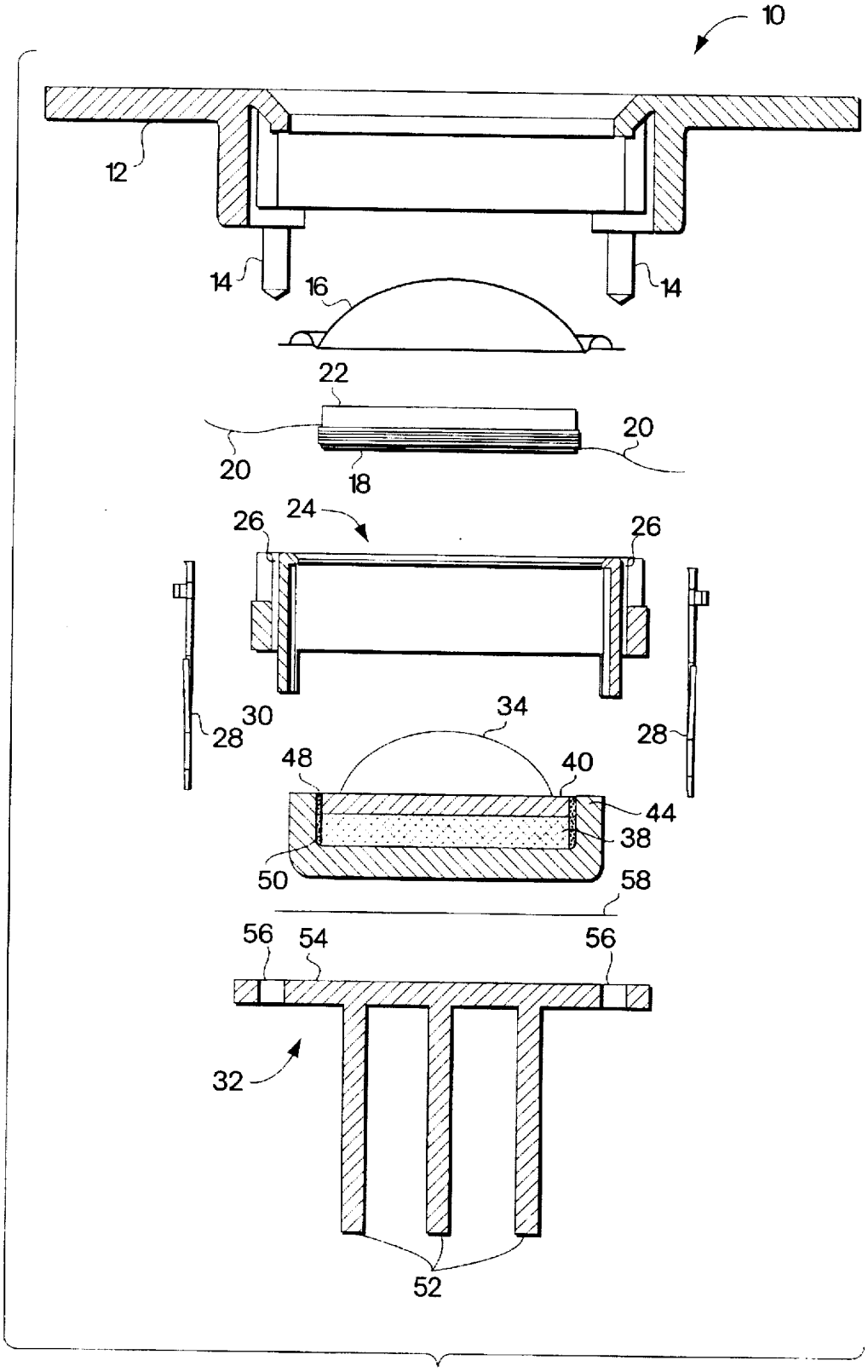
FIG. 1 is an exploded cutaway side view of a tweeter in accordance with a preferred embodiment of the invention.
Figure 1A:
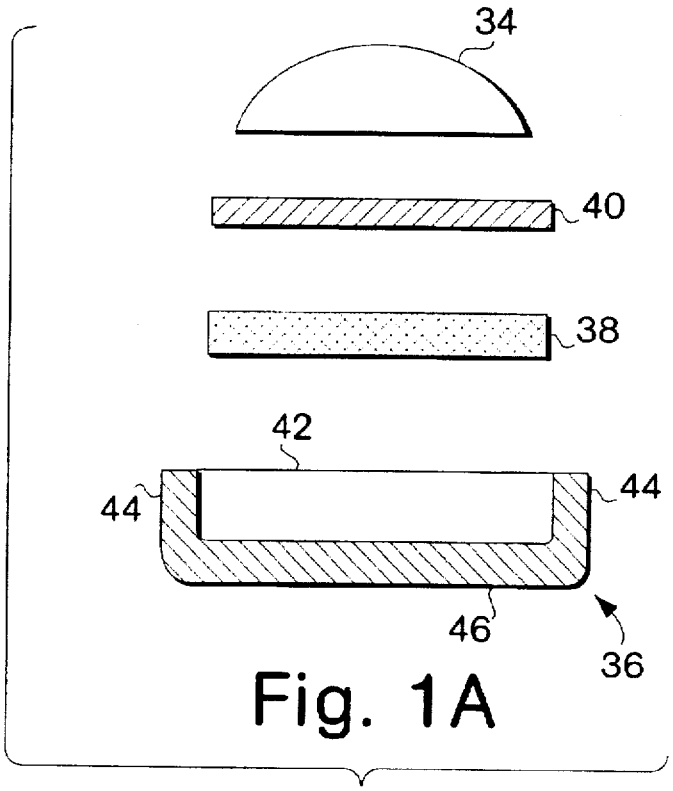
FIG. 1A is an exploded cutaway side view of the yoke assembly shown in FIG. 1.
Figure 2:
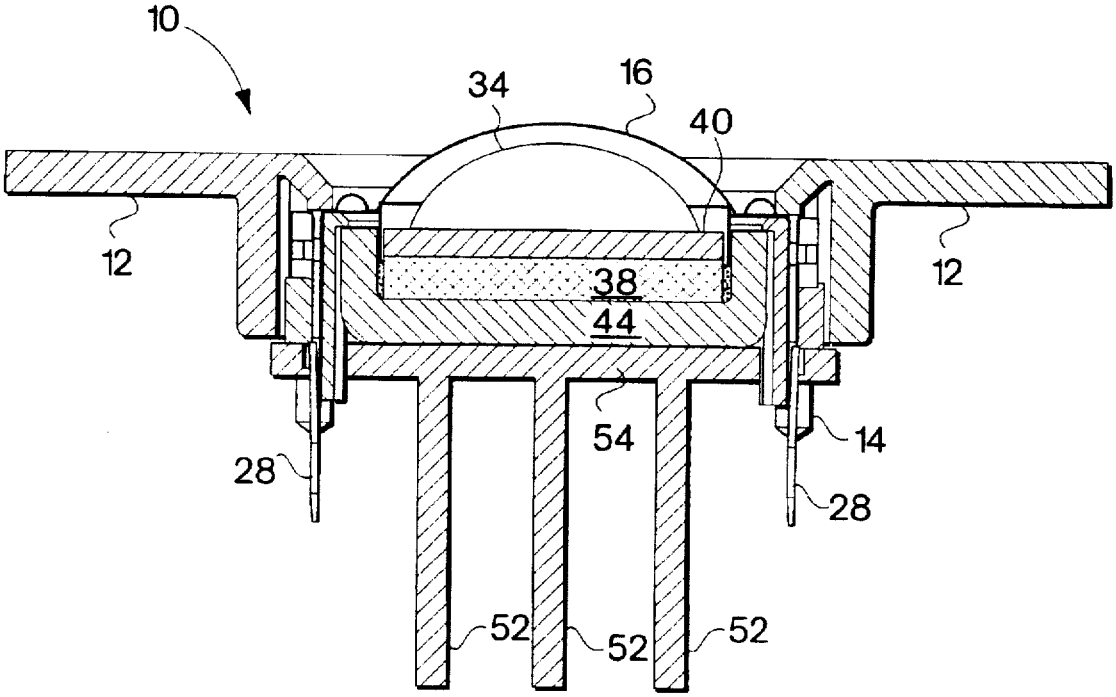
FIG. 2 is a cutaway side view of the speaker shown in FIG. 1 when assembled.

FIGS. 1 and 1A are exploded views illustrating the components of a tweeter in accordance with the teachings of the invention and FIG. 2 shows the same tweeter fully assembled. The tweeter 10 includes a face plate 12 of a plastic or other material having low magnetic permeability. Face plate 12 preferably has a generally rectangular shape with pins or studs 14 extending from a point near each of four corners.

The tweeter also includes a dome diaphragm 16 which, for a preferred embodiment, is roughly one inch in diameter and is formed of pure anodized aluminum. A voice coil 18 having a pair of leads 20 extending therefrom is wrapped on a voice coil bobbin or follower 22. Bobbin 22 would typically be of a low magnetic permeability material such as aluminum or stainless steel. A voice coil carrier 24 is also provided which carrier includes slot 26 for receiving voice coil terminals 28.

The final two elements of the tweeter assembly are a yoke assembly 30 and a heat sink 32. The yoke assembly consists of a foam button 34 which functions as an acoustic damper, a yoke 36 of a ferrous or another high permeability material, a high energy magnet 38, which is a neodymium magnet for preferred embodiments, and a top plate 40 which is also formed of a ferrous/high permeability material. Magnet 40 is sandwiched between top plate 40 and base 46 of yoke 36, making both physical and thermal contact with both components. While face plate 12 and heat sink 32 have a generally rectangular shape for the embodiment shown, the remaining components of the tweeter are generally circular when viewed from the top. As may be best seen in FIG. 1, the diameter of magnet 38 and the diameter of top plate 40 are slightly less than the diameter of an internal opening 42 formed in yoke 36 by side walls 44 and base 46 thereof. This provides a gap 48 in the yoke assembly, which is preferably of substantially uniform thickness, between wall 44 of the yoke and the components positioned in the yoke. For preferred embodiments, this gap is filled with a ferrofluid 50 or with some other substance having good heat transfer characteristics, but which does not interfere with movement of the voice coil.

Heat sink 32 is of a material having high or low magnetic permeability, and good heat transfer characteristics. For preferred embodiments, heat sink 32 is formed of aluminum, but heat sink 32 could also be formed of a ceramic or other material used for heat sink applications. Heat sink 32 preferably has vanes 52 to facilitate the dissipation of heat and also has a generally rectangular-shaped flange 54. A hole 56 is formed near each corner of flange 54 in a position to receive the corresponding stud 14.

Even when two surfaces are in intimate physical contact, because of slight irregularities in the surfaces, there are microscopic air gaps between the surfaces which reduce heat transfer therebetween. Therefore, if desired, heat transfer may be slightly enhanced by providing a thin coat 58 of a heat transfer medium between heat sink 32 and base 46 of yoke 36. This heat transfer medium is a thermally conductive grease for a preferred embodiment, but, where appropriate, could also be a thermally conductive adhesive or other suitable heat transfer medium.

When assembled, as shown in FIG. 2, voice coil 18 is positioned in gap 48 with voice coil bobbin 22 bearing against the underside of diaphragm 16. The ends of diaphragm 16 are pinched between face plate 12 and voice coil carrier 24 and the entire assembly is held together by passing pins or studs 14 through holes 56 in heat sink 32 and then ultrasonically welding or otherwise deforming to ends of the studs to hold the tweeter assembly together.

In operation, current applied to coil 18 through terminals 28 and wires 20 causes the coil to move in gap 48 relative to magnet 38 in a manner known in the art. Coil bobbin 22 moves with coil 18 and applies varying pressures to diaphragm 16 to produce the desired audio output.

Heat generated as a result of current flow through voice coil 18, particularly when large currents are applied thereto to provide the high levels of power required to track transients, passes from the coil through the heat transfer medium/ferrofluid 50 in gap 48 to wall 44 of yoke 36, to top plate 40 and to magnet 38. Heat from the top plate and magnet flow to base 46 of yoke 36. From the walls and base of yoke 36, the heat passes either directly or through transfer medium 58 to heat sink 32 through which it is dissipated. In this way, high power may be applied to coil 18 without risking burning out of the voice coil and without risking heat damage to diaphragm 16.

While the invention has been discussed above with respect to a particular tweeter configuration, it is apparent that various modifications can be made in the size, shape and materials utilized for various components of the tweeter and in the configuration of such components while still remaining within the spirit and scope of the invention. Thus, for example, cone or other types of diaphragm might be used instead of dome diaphragm, and might be actuated in other ways by the voice coil. Heat sink 32 might have a vane configuration other than that shown in the figure, for example vanes projecting at various angles or vanes having various curved configurations to enhance their area, and it is to be understood that any vane configuration for heat sink 32, or even a heat sink configuration not having vanes, are within the contemplation of the invention. Thus, the foregoing and other changes in form and detail may be made in the invention by those skilled in the art while still remaining within the spirit and scope of the invention.

What is claimed is:

1. A high-power, compact tweeter having a front and a rear, sound being emitted from the front of the tweeter, the tweeter comprising:

a high energy magnet;

a yoke of a high magnetic permeability material, the yoke having a base at the rear of the tweeter against the front of which one face of the magnet is in thermal and physical contact and a side wall extending forward from the base, the side wall surrounding, but being spaced by a first selected gap from the sides of the magnet, the base of the yoke having a substantially unbroken rear face;

a high magnetic permeability top plate which is in thermal and physical contact with the face of the magnet opposite said one face, the sides of the top plate being surrounded by and spaced by a second selected gap from the side wall of the yoke, the second gap being aligned with the first gap;

a voice coil positioned in at least one of said selected gaps;

a diaphragm operated in response to the magnet and the coil; and a heat sink component having one side in thermal and physical contact with substantially the entire rear surface of the base of said yoke, and an opposite side from which substantially all heat dissipation from the sink occurs to air toward the rear of the tweeter.

2. A tweeter as claimed in claim 1 including ferrofluid in least the selected gaps in which the voice coil is positioned.

3. A tweeter as claimed in claim 1 wherein said heat sink has vanes extending therefrom to dissipate heat.

4. A tweeter as claimed in claim 1 wherein said heat sink is formed of dye-cast aluminum.

5. A tweeter as claimed in claim 1 wherein said heat sink is formed of a ceramic material having good thermal conductivity.

6. A tweeter as claimed in claim 1 wherein said magnet is a neodymium magnet.

7. A tweeter as claimed in claim 1 including a heat transfer medium between the heat sink component and the yoke to facilitate the thermal contact therebetween.

8. A tweeter as claimed in claim 7 wherein said heat transfer medium is a thermally conductive grease.

9. A tweeter as claimed in claim 1 including a heat transfer medium in said gaps.

* * * * *